US007882815B2

(12) United States Patent
Bugescu et al.

(10) Patent No.: US 7,882,815 B2
(45) **Date of Patent: *Feb. 8, 2011**

(54) HYDRAULIC CAM FOLLOWER

(75) Inventors: Florin Bugescu, Canton, MI (US); Richard Best, Grem, MI (US)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 503 days.

This patent is subject to a terminal disclaimer.

(21) Appl. No.: 11/946,147

(22) Filed: Nov. 28, 2007

(65) Prior Publication Data

US 2008/0141965 A1 Jun. 19, 2008

Related U.S. Application Data

(60) Provisional application No. 60/867,412, filed on Nov. 28, 2006.

(51) Int. Cl.
*F01L 1/14* (2006.01)

(52) U.S. Cl. ..... 123/90.48; 123/90.16; 123/90.44; 123/90.52; 74/569

(58) Field of Classification Search ..... 123/90.48, 123/90.52, 90.55, 90.16, 90.39, 90.44, 90.45, 123/90.56; 74/559, 567, 569
See application file for complete search history.

(56) References Cited

U.S. PATENT DOCUMENTS 7,284,519 B1 * 10/2007 Best et al. ..... 123/90.48
7,617,807 B2 * 11/2009 Diggs et al. ..... 123/90.48
7,637,237 B2 * 12/2009 Evans et al. ..... 123/90.48

* cited by examiner

*Primary Examiner*—Ching Chang
(74) *Attorney, Agent, or Firm*—Volpe and Koenig, P.C.

(57) ABSTRACT

A hydraulic cam follower for simultaneous actuation of several equal-acting gas-exchange valves, especially for a tappet pushrod valve train of an engine, includes an outer part, whose base forms a cam contacting surface, and from whose head hollow-cylindrical guides extend in the same number as the valves in a direction towards the base. A housing of a hydraulic play compensation element is provided in each guide and sits with its bottom side on an inside of the bottom of the outer part. A concentric pressure piston is guided in a borehole starting from a head end of each housing so it can move axially. A non-return valve is located at a bottom-side base of the piston and a high-pressure space is formed axially between the base and the bottom side of the housing. A reservoir for hydraulic medium is formed between the base and a head end of the piston.

10 Claims, 1 Drawing Sheet

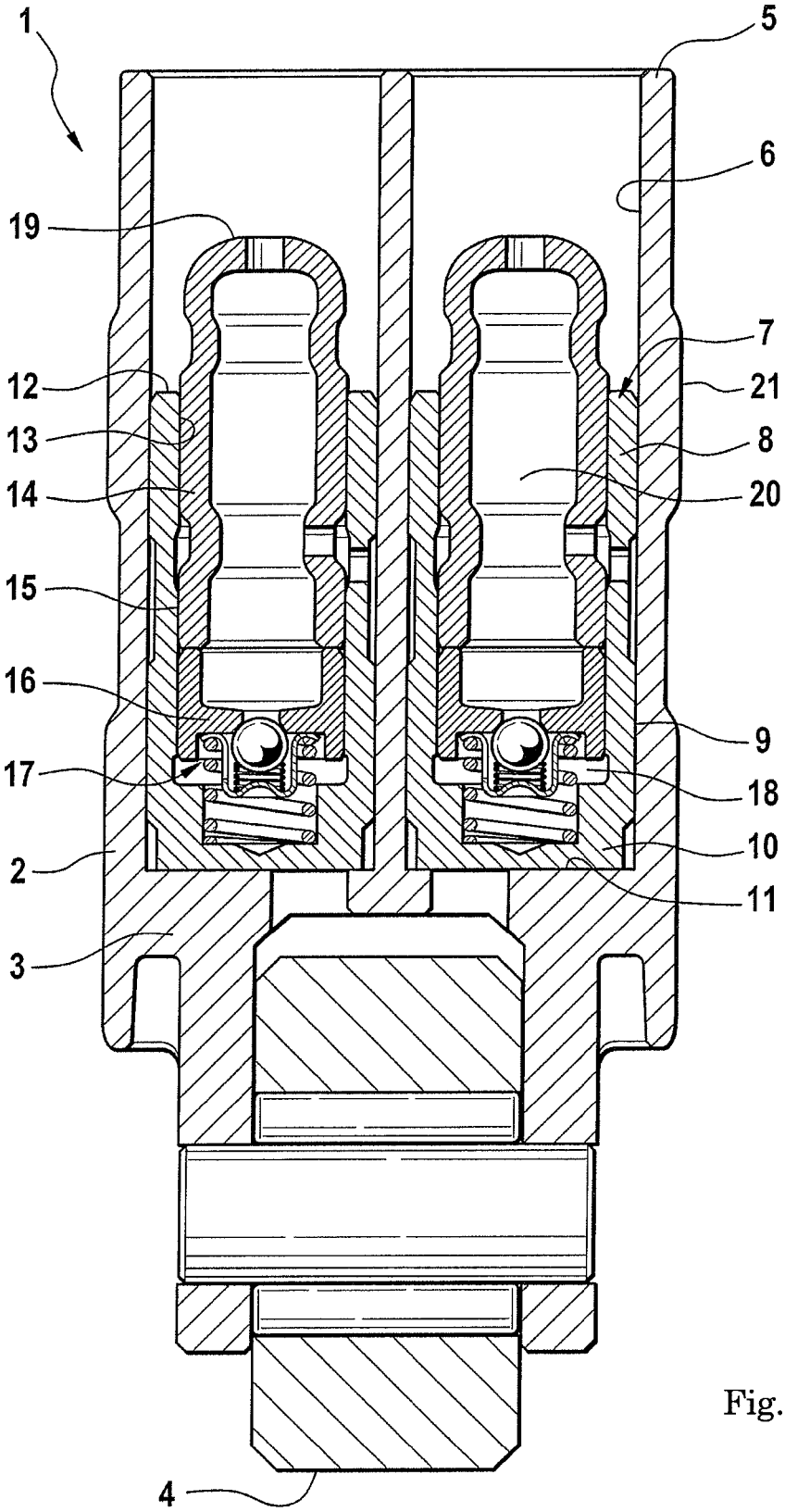
Fig.

HYDRAULIC CAM FOLLOWER

CROSS-REFERENCE TO RELATED APPLICATIONS

This application claims the benefit of U.S. Provisional Application 60/867,412. filed Nov. 28, 2006, which is incorporated herein by reference as if fully set forth.

BACKGROUND

The invention relates to a hydraulic cam follower for the simultaneous actuation of several identically actuated gas-exchange valves, especially for a cam follower for a tappet pushrod valve train of an internal combustion engine.

In the "single" action cam followers or roller tappets known from the state of the art, the pressure piston runs directly in a respective borehole of the housing of the cam follower with one end for supporting the tappet pushrod with its outer casing. Here, the outer casing and borehole are fine-machined through grinding for forming a hydraulic leakage gap. In practice, for cam follower diameters typical today, a high diameter accuracy of, for example, 5 μm at $R_z$ 1.5 is required.

However, if in a preferably cylindrical housing of the cam follower, two pressure pistons lying one next to the other are applied in corresponding non-concentric guides, of which each communicates with one tappet pushrod, then fine machining of these guides through grinding has proven to be extremely complicated.

SUMMARY

Therefore, the object of the invention is to create a hydraulic cam follower of the type noted above, whose processing costs are reduced.

This objective is met by the features according to the invention, as described below, which may be separately protectable in their own right.

Consequently, a hydraulic cam follower is provided for the simultaneous actuation of several equal-action gas-exchange valves, preferably for the actuation of two identically actuated gas-exchange valves, whose guides are formed by a relatively economical cutting process, such as internal round reaming or internal round broaching, wherein a housing is "buffered" between the pressure piston and guide, whose outer casing (together with the borehole of the housing) is fine-machined "separately" by grinding.

The pressure piston and the "intermediate housing" provided for this purpose are mounted in advance externally, wherein the actual leakage gap is thus created between the borehole of the housing and the outer casing of the pressure piston through fine machining, such as grinding.

The range of protection of the invention is related, in particular, but not exclusively, to so-called roller tappets in tappet pushrod drives. Conceivable are also other lift-transmitting elements in valve trains of hydraulic construction or hydraulic support elements for lever-type cam followers, which are assembled in a common housing.

It is preferred when hydraulic support elements known from mass production are provided as the housing with installed pressure pistons and non-return valve. If necessary, these can be slightly modified. Thus, these support elements are inserted with their ground outer casing into the guides of the outer part formed by inner round reaming or inner round broaching with a "suction" action. Here, the same tolerances/fits can be achieved, like in the other installation of the support elements in their receptacles in the cylinder head. For example, for a support element with 12 mm diameter, the borehole of the cylinder head has tolerances in the range of +6 μm to +17 μm and the outer casing of the housing of the support element has tolerances in the range of 0 μm to −11 μm. For a cam follower according to the invention, the housing is not prevented from rotating.

The intended reaming or broaching process for the guide has proven to be significantly less expensive than the grinding processing, which must be done eccentrically, that is necessary for the direct insertion of the pressure piston into the guide. At this point, it is clear to someone skilled in the art that grinding boreholes positioned eccentrically in a cylindrical component is relatively cost-intensive.

Preferably, the guides should be arranged one next to the other in the cam follower according to the application, so that they run one behind the other in the camshaft direction when installed. Optionally, a cam follower with three or more guides is also conceivable and provided.

In one embodiment of the invention it is possible to form at least the outer part in terms of the original mold through fine casting or else also through extrusion. Alternatively, a sheet-metal construction or some other cutting production is also conceivable and provided.

In particular, when the bottom of the outer part is not closed, each guide can be fine machined by inner round reaming with particularly good results, wherein here, for achieving a sufficiently high surface quality and dimensional accuracy, the reaming tool can have calibrating teeth.

In a realization of the invention, the guides can be applied in a component bridging the outer part in a similar manner to eyeglasses.

It can be advantageous when the pressure pistons have an integral construction in the separate housings. Optionally, a two-part construction is also conceivable and provided.

The present cam follower can be formed with a so-called "valve lift cut-off switch" or as "valve lift changing switch," wherein it has, e.g., radially displaceable coupling means not designated in more detail here.

As a preferred cam contact, a rotating and preferably cylinder-supported roller is provided. In the case of the construction as a valve lift changing switch, optionally several cam contacting rollers or surfaces are also necessary in the area of the base.

BRIEF DESCRIPTION OF THE DRAWING

The invention is explained in more detail with reference to the drawing. The single FIGURE shows a longitudinal section through a cam follower according to the invention.

DETAILED DESCRIPTION OF THE PREFERRED EMBODIMENT

The FIGURE discloses a so-called double-action, hydraulic cam follower 1. The cam follower 1 has a cylindrical outer guide surface 21. A cam contacting surface 4 constructed as a rotating roller runs in the region of its bottom 3. Two hollow cylindrical guides 6 located one next to the other in the direction of the internal combustion engine when installed extend starting from its head 5 facing away from the bottom 3. A housing 7 with a respective pressure piston 14 is inserted into each guide 6 through its outer casing 9 with a "suction" action. Each housing 7 extends with its bottom side 10 on an inner side 11 of the bottom 3.

Each pressure piston 14 sits with its outer casing 15 so that it can move axially relative to a borehole 13 of the housing 7.

Between the outer casing 15 and the borehole 13, a known leakage gap for hydraulic medium is formed from a high-pressure space 18. The latter runs axially between a base 16 of the pressure piston 14 and the base side 10 of the housing 7.

A reservoir 20 for hydraulic medium, which is limited in the direction away from the bottom by an end 19, is enclosed by the pressure piston 14 axially above the base 16. On each end 19, an end of a tappet pushrod can be supported when installed. Optionally, the cam follower 1 can also act directly on corresponding bottom sides of rocker arms.

According to the invention, for the fine processing of guides 6, a relatively cost-effective cutting process, such as inner round reaming or inner round broaching is applied. The outer casing 9 of each housing 7 is here fine machined through grinding according to known means and methods.

In other words, a direct guide of the pressure piston 14 in the guides 6 is avoided through the "intermediate arrangement" of the housing 7. The cutting process noted above, such as inner round reaming is significantly more cost-effective than a grinding process for the guides 6 that extend eccentrically.

Actual fine machine through grinding for creating the necessary leakage gap for the play equalization thus takes place between the outer casings 15 of the pressure piston 14 and the corresponding boreholes 13 of the housing 7. The component 7/pressure piston 14 is preferably delivered completely pre-assembled and inserted in the corresponding guide 6. Here it is especially preferred to revert to previous hydraulic support elements from mass production and to modify these only slightly if necessary.

LIST OF REFERENCE SYMBOLS

1) Cam follower
2) Outer part
3) Bottom
4) Cam contacting surface
5) Head
6) Guide
7) Housing
8) Play compensating element
9) Outer casing
10) Bottom side
11) Inner side
12) End side
13) Borehole
14) Pressure piston
15) Outer casing
16) Base
17) Non-return valve
18) High-pressure space
19) End
20) Reservoir
21) Outer guide surface

The invention claimed is:

1. A hydraulic cam follower for the simultaneous actuation of several equal-acting gas exchange valves for a tappet pushrod valve train of an internal combustion engine, the cam follower comprising an outer part, having a bottom that forms or is at least indirectly connected to a cam contacting surface, and hollow cylindrical round broached or round reamed guides extend from a head of the outer part, in a number equal to a number of the equal-actuated gas exchange valves, in a direction toward the bottom, wherein in each of the hollow cylindrical guides a housing of a hydraulic play equalization element is provided with fine machined, ground outer casing that sits with a bottom side thereof on an inner side of the bottom of the outer part, wherein a concentric pressure piston is guided in a borehole of each of the housings starting from a head-side end of each of the housings and the concentric pressure piston is arranged so that it can move axially via an outer casing thereof, a non-return valve is provided at a bottom-side base of the concentric pressure piston, and a high-pressure space is provided axially between the bottom-side base and a bottom side of the housing, and a reservoir for hydraulic medium is formed between the bottom-side base and a head-side end of the pressure piston.

2. The hydraulic cam follower according to claim 1, wherein the outer part has an at least essentially cylindrical or an elliptical outer guide surface extending in a direction of the internal combustion engine.

3. The hydraulic cam follower according to claim 1, wherein the hollow cylindrical guides include exactly two guides lying one behind the other viewed in a direction of the internal combustion engine arranged in the outer part, such that in cross section a bridge-like profile is provided and wherein axes thereof are equidistant to an axis of the outer part.

4. The hydraulic cam follower according to claim 1, wherein each of the housings is inserted with the concentric pressure piston into a respective one of the guides with a "suction" action.

5. The hydraulic cam follower according to claim 1, wherein the concentric pressure pistons are integrally formed with the bottom-side base.

6. The hydraulic cam follower according to claim 1, wherein the concentric pressure pistons each comprise two separate longitudinal sections, a top one of the longitudinal sections is provided with the head-side end and a lower one of the longitudinal sections is provided with the bottom-side base and the non-return valve.

7. The hydraulic cam follower according to claim 1, wherein the housings with concentric pressure pistons and non-return valves form serial or generally serially assembled hydraulic support elements.

8. The hydraulic cam follower according to claim 1, wherein a roller is provided as the cam contacting surface on the bottom of the outer part.

9. The hydraulic cam follower according to claim 1, wherein the outer part is formed through a non-cutting process.

10. The hydraulic cam follower according to claim 1, wherein the outer part is formed by extrusion or casting, or is made from a steel sheet.

* * * * *